US008852449B2

(12) United States Patent
Carr et al.

(10) Patent No.: US 8,852,449 B2
(45) Date of Patent: Oct. 7, 2014

(54) REFRIGERATION OIL AND COMPOSITIONS WITH CARBON DIOXIDE REFRIGERANT

(75) Inventors: Dale Carr, Morristown, NJ (US); Jeffrey Hutter, Edison, NJ (US); Richard Kelley, Princeton, NJ (US); Robert Urrego, Newington, CT (US); Edward T. Hessell, Fairfield, CT (US)

(73) Assignee: Chemtura Corporation, Middlebury, CT (US)

( * ) Notice: Subject to any disclaimer, the term of this patent is extended or adjusted under 35 U.S.C. 154(b) by 46 days.

(21) Appl. No.: 13/080,739

(22) Filed: Apr. 6, 2011

(65) Prior Publication Data

US 2011/0240910 A1 Oct. 6, 2011

Related U.S. Application Data

(60) Provisional application No. 61/341,940, filed on Apr. 6, 2010.

(51) Int. Cl.

| | |
|---|---|
| ***C09K 5/04*** | (2006.01) |
| ***C10M 177/00*** | (2006.01) |
| ***C10M 171/00*** | (2006.01) |

(52) U.S. Cl.

CPC ..... *C10M 171/008* (2013.01); *C10N 2240/30* (2013.01); *C10N 2220/306* (2013.01); *C10M 2207/2835* (2013.01); *C10N 2270/00* (2013.01); *C10M 177/00* (2013.01); *C10N 2220/022* (2013.01)

USPC ..... 252/68; 508/485

(58) Field of Classification Search

USPC ..... 252/68; 508/485

See application file for complete search history.

(56) References Cited

U.S. PATENT DOCUMENTS

| | | | | |
|---|---|---|---|---|
| 3,670,013 | A * | 6/1972 | Leibfried | 560/263 |
| 5,895,778 | A * | 4/1999 | McHenry et al. | 508/495 |
| 6,774,093 | B2 * | 8/2004 | Carr et al. | 508/485 |
| 8,318,647 | B2 * | 11/2012 | Carr et al. | 508/485 |
| 2005/0127320 | A1 * | 6/2005 | Fahl et al. | 252/68 |

* cited by examiner

*Primary Examiner* — John Hardee

(74) *Attorney, Agent, or Firm* — Joseph Suhadolnik; George Romanik; Chemtura Corporation

(57) ABSTRACT

Lubricant compositions comprising certain mixtures of esters of pentaerythritol, di-pentaerythritol, tri-pentaerythritol and higher pentaerythritol oligomers are ideally suited for use with $CO_2$ as refrigerant in heat transfer devices provided that at least 30% by weight of the esters are esters of pentaerythritol oligomers containing 4 or more pentaerythritol monomer units and wherein a majority of the alkylcarboxylate groups are straight chain $C_{3-6}$ alkanoyl groups, such as n-pentanoyl. Said mixture of alkylcarboxylate esters are shown to not only have higher than expected viscosity and exceptional $CO_2$ miscibility, but also possess excellent lubricity, film building properties and load bearing properties even as part of a lubricant/$CO_2$ solution.

5 Claims, No Drawings

REFRIGERATION OIL AND COMPOSITIONS WITH CARBON DIOXIDE REFRIGERANT

This application claims the benefit of the filing date of U.S. Provisional Application No. 61/341,940, filed Apr. 6, 2010, the contents of which are incorporated herein by reference.

This invention provides polyol ester lubricant compositions, suitable as lubricants for heat transfer devices, including refrigeration and air conditioning systems, and working fluids comprising the polyol ester lubricant compositions and carbon dioxide refrigerant, said lubricant compositions comprising a mixture of alkylcarboxy esters of neopentyl polyols, said polyols selected from pentaerythritol, di-pentaerythritol, tri-pentaerythritol and pentaerythritol oligomers, wherein a majority of the alkylcarboxy groups are derived from $C_{3-6}$ linear carboxylic acids, in particular n-pentanoic acid, and which mixture comprises at least 30% by weight alkylcarboxy esters of pentaerythritol oligomers containing 4 or more pentaerythritol monomer units based on the combined weight of the neopentyl polyol alkylcarboxy esters.

Heat transfer devices such as refrigerators, freezers, heat pumps and air conditioning systems are well known. In simple terms such devices operate via a cycle wherein a refrigerant of a suitable boiling point evaporates at low pressure taking heat from its surroundings, the vapor passes to a condenser where it condenses back to a liquid and gives off heat to its new surroundings, before returning to the evaporator completing the cycle. In addition to the mechanical parts, such as a compressor etc, specially suited materials are needed, including refrigerant, suitable heat transfer materials, sealants to prevent loss of refrigerant and lubricants to allow for functioning of the movable parts of the device. The combination of lubricant and refrigerant in a heat transfer device is referred to as the working fluid.

The lubricant in these devices must have good low temperature flow properties, be thermally stable, provide protection against wear of moving parts such as bearings under load, remove heat from the compressor and seal clearances to ensure efficient compression of gas from low to high pressure. A well chosen lubricant may also assist in noise reduction.

The refrigeration lubricant must also be compatible with the refrigerant. In the compressor, the working fluid typically is comprised largely of lubricant and is thought of as a solution of refrigerant dissolved in the lubricant. In other parts of the device, such as the evaporator, there is a larger proportion of refrigerant than lubricant and the working fluid may be thought of as lubricant dissolved in the refrigerant. It is generally very important to have a high degree of miscibility of lubricant in the refrigerant, especially in the evaporator, which is the most likely place for phase separation to occur in a refrigeration system as it is the coldest part of the system. Partial miscibility may cause problems with heat transfer and may also interfere with the return of oil to the compressor.

Lubricants are therefore classified as completely miscible, partially miscible, or immiscible with refrigerants depending on their degree of mutual solubility. Partially miscible mixtures of refrigerant and lubricants are mutually soluble at certain temperatures and lubricant-in-refrigerant concentrations, and separate into two or more liquid phases under other conditions.

Commercial development and environmental concerns have led to advances in the manufacture and use of new lubricants for a variety of industrial and commercial applications. In the heat transfer devices referred to above, concern about ozone depletion has lead to replacement of traditional chlorofluorocarbon refrigerants with new or alternate materials. As efficient functioning of a refrigeration lubricant requires not just proper lubricating properties and appropriate viscosities, but also compatibility with the refrigerant, changes in refrigerant demand corresponding changes in lubricant.

Carbon dioxide ($CO_2$) is well known refrigerant that is seeing increased use in modern heat transfer devices. It is harmless to the ozone layer, is present in the atmosphere and is generally safe to human beings. Although it is considered a "green house gas" and excess production of $CO_2$ has been linked to global warming, it is possible to recycle $CO_2$ already generated in other industrial processes as a refrigerant and thus the net effect of using $CO_2$ as a refrigerant on the environment can be minimal. However, using $CO_2$ as a refrigerant can be problematic in that it is not properly miscible with many common refrigerator lubricating oils, e.g., mineral oils and alkyl benzenes, and in certain cases where it is miscible with the oil, the resulting oil composition has poor lubricity and/or load bearing properties impairing its ability to adequately lubricate and protect the mechanical parts of the device.

Synthetic ester based lubricants are known as effective refrigeration lubricants in many systems. U.S. Pat. No. 6,444,626 for example discloses formulated fluids well suited for use as a coolant or lubricant comprising poly(pentaerythritol) esters as lubricant base stocks. These and similar pentaerythritol ester compositions typically contain mixtures of, e.g., pentaerythritol and di-pentaerythritol esters; may also contain tri-pentaerythritol esters and compositions containing small amounts of tetra- and higher oligomeric pentaerythritol esters are known. The synthesis of such esters from polyol and carboxylic acid is conceptually straightforward and methods which influence the product profile of the pentaerythritol ester mixtures are disclosed, e.g., U.S. Pat. No. 3,670,013. Co-pending U.S. patent application Ser. No. 12/691,300 discloses refrigeration lubricants comprising select mixtures of carboxy esters of pentaerythritol, di-pentaerythritol and tri-pentaerythritol.

U.S. Pat. No. 6,013,609 discloses non-foaming refrigerator oil containing oxygenated organic compounds such as esters which are suitable for use with many refrigerants including $CO_2$ although the disclosure of the refrigerator oils is generic and no oils particularly suited for use with $CO_2$ as refrigerant are identified.

U.S. Pat. No. 6,117,356 discloses a refrigerant mixture containing $CO_2$ and other known refrigerants which can be used with ether or ester refrigerator lubricants including esters of pentaerythritol, di-pentaerythritol and tri-pentaerythritol. U.S. Pat. Nos. 6,263,683 and 6,354,094 disclose refrigerator oil compositions comprising $CO_2$ as refrigerant and pentaerythritol esters as base stock, which are particularly suitable for compression refrigeration cycles equipped with an oil separator and/or hot gas line. US Pub Pat Appl 2007/0272893 also discloses refrigerator oil compositions using $CO_2$ as refrigerant.

There is however still a need for new lubricants with an improved combination of physical properties for use with $CO_2$ refrigerants. One reason is that the lubrication requirements for carbon dioxide-based refrigeration compressors and equipment are typically more demanding than those for equipment using hydrofluorocarbon (HFC) refrigerants, in part because the pressures involved in the more energy efficient transcritical refrigeration cycle for carbon dioxide can be extremely high (>120 Bar).

The higher pressure places greater demands on the lubricant for the sealing of clearances in order to maintain proper compression ratio, which is important for high energy volumetric efficiency. The high pressure also results in a higher concentration of refrigerant in the lubricant which can result in increased viscosity dilution of the oil and higher pressure places higher loads on the load bearing surfaces in contact.

Carbon dioxide can be very soluble in some lubricants designed to be used with HFCs such as polyol esters (POEs). POEs used with HFCs such as R-134a and R-410a are typically much more soluble in carbon dioxide resulting in significant viscosity reduction of the working fluid. For this reason, POE lubricants recommended for use today with $CO_2$ are typically several ISO viscosity grades higher than would normally be used with HFC refrigerants. Higher viscosity leads to increase viscous drag during start up, resulting in greater energy consumption, e.g., energy consumption of a compressor can be directly related to the viscosity of the lubricant. While lower viscosity lubricants may result in better energy efficiency, this must be balanced with the need for long term prevention of wear and service life of the compressor.

U.S. Pat. No. 5,486,302 discloses higher viscosity POE lubricants obtained by esterification of polyol with branched chain carboxylic acids; unfortunately, these branched chain esters exhibit insufficient lubricity for use in heat transfer devices employing $CO_2$.

Co-pending U.S. patent application Ser. No. 12/684,315 discloses refrigeration lubricants comprising mixtures of carboxy esters of mono-, di-, tri-, tetra- and higher oligomers of pentaerythritol, wherein at least 25% are esters of tetra-pentaerythritol or higher oligomers, which have high viscosity and lubricity characteristics desirable use with $CO_2$. Ester mixtures high in carboxy groups containing 7 or more carbons, e.g. n-heptylcarboxy, are preferred.

It has been found that lubricants similar to those of U.S. patent application Ser. No. 12/684,315, but which contain predominately esters of straight chain C linear carboxylic acids, for example, n-pentanoic acid esters, and which comprise 30 wt or % more of esters of pentaerythritol oligomers containing 4 or more pentaerythritol groups are better suited for use in working fluids with $CO_2$, providing excellent viscosity and lubricity along with unexpectedly superior miscibility with $CO_2$ refrigerant.

SUMMARY OF THE INVENTION

This invention provides a polyol ester lubricant composition, a method for preparing the polyol ester lubricant composition, and a working fluid comprising the polyol ester lubricant composition and carbon dioxide as refrigerant, which polyol ester lubricant composition comprises alkylcarboxy esters of neopentyl polyols, said polyols being selected from pentaerythritol, di-pentaerythritol, tri-pentaerythritol and pentaerythritol oligomers, wherein a majority of the alkylcarboxy groups are derived from straight chain $C_{3-6}$ carboxylic acids, for example n-pentanoic acid or n-hexanoic acid, in particular n-pentanoic acid, and wherein at least 30% of the combined weight of pentaerythritol, di-pentaerythritol tri-pentaerythritol and (poly)pentaerythritol oligomer alkylcarboxylate esters is made up of alkylcarboxy esters of pentaerythritol oligomers containing 4 or more pentaerythritol repeating units.

The polyol ester lubricant of the invention is ideally suited for use in refrigeration working fluids comprising $CO_2$, demonstrating higher than expected $CO_2$ miscibility along with excellent viscosity, lubricity and load, bearing properties, even in the presence of high pressures and large concentrations of $CO_2$ refrigerant.

The mixture of polyol esters may be conveniently prepared in a two step process by reacting pentaerythritol with less than a stoichiometric amount of carboxylic, acid based on available hydroxyl groups under strong acid catalysis at elevated temperatures to form a mixture of partial esters of pentaerythritol, dipentaerythritol and higher polypentaerythritols; partial esters being polyol compounds wherein some but not all of the hydroxyl groups are esterified. The amount of oligomerization and the viscosity, can be controlled by the amount of time the reaction is allowed to proceed and is influenced by the amount of carboxylic acid added the temperature and other easily varied reaction parameters. After neutralizing the strong acid the remaining hydroxyl groups are esterified in a second step with additional carboxylic acid using by standard means.

The lubricant compositions of the invention, including the $CO_2$ refrigerant containing working fluids, are compatible with standard additives common in the field.

DESCRIPTION OF THE INVENTION

A working fluid for a heat transfer device comprising i) $CO_2$ as a refrigerant; and ii) a polyol ester lubricant composition comprising a mixture of esters of formula I

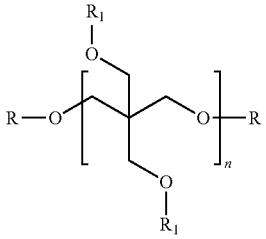

wherein n is an integer of from 1 to 20, each R is independently an alkyl carbonyl of from 3 to 12 carbon atoms, each $R_1$ is independently selected and is either a group R or a substituent of formula II:

II

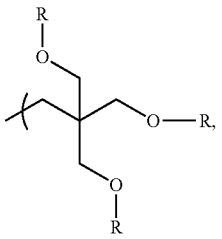

wherein at least 50% of all groups R in the compounds of formula I present in the working fluid are linear alkyl carbonyl of 3 to 6 carbon atoms, typically n-pentanoyl, and which polyol ester lubricant composition comprises:

a) from 20 to 45 wt % compounds of formula I wherein n is 1 and each $R_1$ is independently selected and is a group R, i.e., mono-pentaerythritol esters b) from 15 to 20 wt % compounds of formula I wherein n is 2 and each $R_1$ is independently selected and is a group R, i.e., di-pentaerythritol esters c) from 10 to 15 wt % compounds of formula I wherein n is 3 and each $R_1$ is independently selected and is a group R, i.e., tri-pentaerythritol esters and d) from 30 to 55 wt % compounds of formula I which are pentaerythritol oligomers of 4 or more pentaerythritol monomer groups.

In some embodiments, at least 35% of all compounds of formula I in the polyol ester lubricant composition are esters of pentaerythritol oligomers of 4 or more pentaerythritol monomer groups.

While n is an integer of from 1 to 20, n is often an integer of from 1 to 12, e.g., 1 to 10.

Each R is independently an alkylcarbonyl of 3 to 12 carbon atoms, which can be linear or branched. In one embodiment, at least 60 to 100%, e.g., 70 to 100% of all alkylcarbonyls are linear. In one embodiment all alkylcarbonyls are linear. In one embodiment, each R is independently an alkylcarbonyl of 4 to 10 carbon atoms; in another embodiment, each R is independently an alkylcarbonyl of 5 to 10 carbon atoms.

At least 50%, and in some embodiments at least 60% or at least 70%, of all groups R are linear alkyl carbonyl of 3 to 6 carbon atoms, that is, n-propanoyl, n-butanoyl, n-pentanoyl or n-hexanoyl. Often, at least 50% of all groups R are n-pentanoyl or n-hexanoyl, for example n-pentanoyl. For example, in some embodiments at least 50%, at least 60% or at least 70% of all groups Rare n-pentanoyl.

Of course, at least 50%, at least 60% or at least 70% etc, means from about 50% to about 100% from about 60% to about 100%, or from about 70% to about 100%.

In one embodiment, at least 70% to 100% of all R groups in the mixture of compounds of formula I are selected from isomers of alkyl carbonyl groups of 5 carbon atoms, i.e., n-pentanoyl, 2-methylbutanoyl, 3-methylbutanoyl and 2,2-dimethylpropanoyl.

The compounds of formula I which are pentaerythritol oligomers can be linear or branched depending on whether any of the groups $R_1$ are a substituent of formula II, i.e., an esterified pentaerythritol group. For example, an oligomer of formula I wherein n is 4, i.e., formula III, can be a linear pentaerythritol tetramer if all $R_1$ groups are alkylcarbonyl. However, any number of the $R_1$ groups can be a pentaerythritol group of formula II, and if, for example, the $R_1$ group marked with the arrow is a group of formula II, the result would be a branched pentaerythritol pentamer, i.e., a branched oligomer of 5 pentaerythritol monomer units.

III

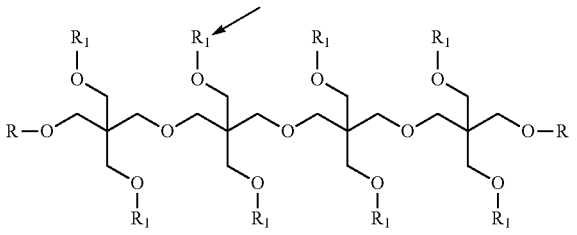

Thus, an oligomer of formula I of 4 pentaerythritol monomer units or more does not require that n in formula I is 4 or more. The compound of formula IV is an oligomer of formula I with 4 pentaerythritol units where n is 3 and one $R_1$ group is a pentaerythritol group:

IV

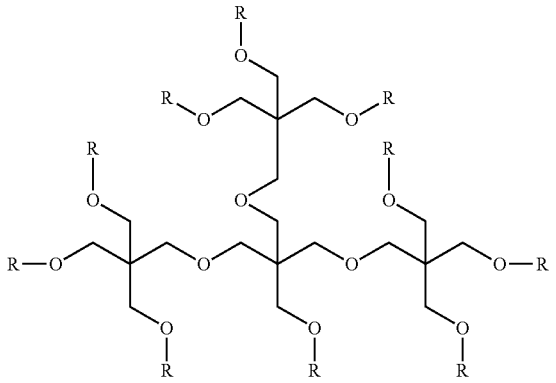

and the compound of formula V is an oligomer of formula I with 5 pentaerythritol units where n is 3 and two groups $R_1$ are pentaerythritol:

V

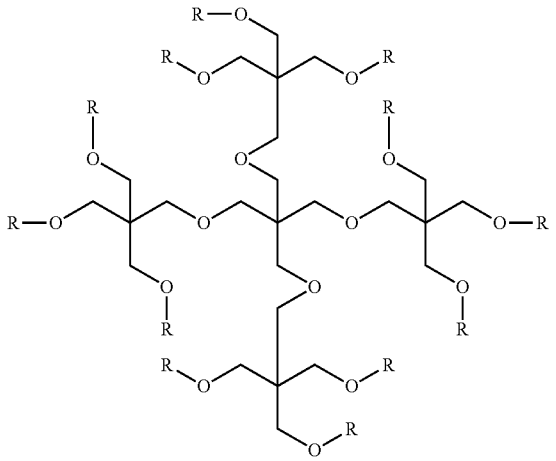

Other compounds similar to those of formula I described above may be present in the working fluid. For example, incomplete esterification may lead to the presence of compounds wherein one or more R groups are hydrogen and higher oligomers showing greater degrees of branching are also possible depending on the synthetic method used.

The mixture of esters may be prepared by simple esterification of the appropriate pentaerythritol, dipentaerythritol, and poly(pentaerythritol)s, however this requires obtaining the individual polyols as starting materials.

The polyol ester composition is more conveniently prepared by another embodiment of the invention, that is, a two step process similar to that described in U.S. Pat. No. 3,670,013. In the first step, pentaerythritol, a strong acid catalyst, and a $C_3$ to $C_{12}$ monocarboxylic acid or mixture of said acids are charged to a reaction vessel such that the mole ratio of carboxyl groups to hydroxyl groups is less than 1:1, for example from about 1:4 to about 1:2. Examples of suitable strong acid catalysts include mineral acids, for example, sulfuric acid, hydrochloric acid, and the like, and sulfonic acids, for example, benzenesulfonic acid, toluenesulfonic acid, polystyrene sulfonic acid, methanesulfonic acid, ethanesulfonic acid, and the like. The reaction mixture is then heated to a temperature of between about 150° C. and about 250° C., typically between about 170° C. and about 200° C., while water vapor is continuously removed from the reaction vessel, generally by the application of a vacuum.

Any carboxylic acid which co-distills with the water vapor may be returned to the reactor or replaced by adding a replacement portion of carboxylic acid. A degree of pentaerythritol oligomerization occurs under the conditions generating a mixture of partial esters of pentaerythritol, di-pentaerythritol, tri-pentaerythritol and higher polypentaerythritols. The amount of oligomerization, and thus the viscosity, can be controlled by the amount of time the reaction of the first step is allowed to proceed at elevated temperatures. This can be determined by experimentation, such as checking the viscosity of the reaction mixture or taking spectroscopic measurements, or may be estimated by collecting an amount of water calculated to correspond to the desired amount of amount of water of reaction liberated by the formation of the ester groups and the pentaerythritol ether linkages formed by dimer or oligomer formation.

Optionally, the acid catalyst is neutralized with alkali at the end of the first reaction step.

The second step of the process completes the esterification of the partial esters. Thus, additional $C_3$ to $C_{12}$ monocarboxylic acid or acid mixture acid and optionally an esterification catalyst is added to the reaction mixture. The additional carboxylic acid can be the same as or different from that used in the initial step and is generally added in amount to provide a 10 to 25 percent excess of carboxyl groups, with respect to hydroxyl groups. The reaction mixture is then heated to complete the esterification under conditions well known for ester formation.

Any known catalyst, or no catalyst may be employed in the second step, such as acid catalysts, acid salts, metal catalysts such as organo metallic catalysts, clays etc. Good results have been obtained using tin oxylate and/or activated carbon and in some instances, no added catalyst was required for the second step.

The resulting mixture of esters may be used without further purification or may be purified using conventional techniques such as distillation, treatment with acid scavengers to remove trace acidity, treatment with moisture scavengers to remove moisture and/or filtration to improve clarity.

Di-pentaerythritol is often present at the beginning of the process, particularly as technical grades of the pentaerythritol starting material often contain some of this dimer. Small amounts of other pentaerythritol oligomers may also be present in the starting materials.

For example, according to the process, 25 moles of pentaerythritol is mixed with approximately 50 moles of n-pentanoic acid. As pentaerythritol contains four hydroxyl groups, this amount of acid represents only half of the stoichiometric equivalence needed for full esterification. A catalytic amount of sulfuric acid or methane sulfonic acid is also added. About 10 milimoles of acid catalyst is often sufficient but there is no limitation on the amount of catalyst used and higher amounts are common. The mixture is stirred or otherwise agitated and heated to about 160 to about 200° C., for example from about 170 to about 180° C., and water is collected, for example in a Dean Stark trap. The amount of time that the reaction is heated depends on how much polymerization is desired.

The reaction is then cooled and the acid catalyst is neutralized by addition of a base, e.g., sodium hydroxide. Carboxylic acid, for example n-pentanoic acid, sufficient to react with any remaining hydroxyl groups and any optional catalyst is added to complete the esterification. The reaction mixture is the heated with mixing and water is collected until the reaction is complete. In this step the temperature of reaction may vary depending on whether a catalyst is employed and what that catalyst may be therefore temperatures may be encountered that are higher or lower than used in the first step.

The amount of carboxylic acid included in the initial charge can vary widely so long as it is less than the amount needed to esterify all hydroxy groups present. As mentioned above, dipentaerythritol and polypentaerythritol may included in the initial charge of starting materials and when this is the case one must consider different hydroxyl group quantities available on the dimers and polymers when determining the amount of carboxylic acid to add.

One advantage of this process is that one can start with readily available starting materials. Another advantage is that the degree of oligomerization can be controlled by simply varying the length of time the reaction mixture is exposed to strong acids at elevated temperature, which allows one to effectively control the viscosity of the resulting ester composition. That is, longer reaction times at elevated temperature in the first step lead to higher viscosity.

The polyol ester compositions containing esters of formula I as defined above are all conveniently prepared by this process.

The ester composition produced can also be blended with other lubricants, such as polyalphaolefins, polyalkylene glycols, alkylated aromatics, polyvinyl ethers, mineral oils, other ester based lubricants, vegetable oils etc. However, the combination of polyol esters of formula I defined above is typically the majority lubricant component, or in some embodiments the only lubricant, used in the working fluid and care must be used when formulating in other lubricant base stocks so that the desirable properties of the polyol ester composition relative to its use with $CO_2$ are not diminished.

In general, to be useful in a working fluid with $CO_2$, the lubricant composition should have a viscosity, as measured without refrigerant at 40° C., of from 30 cSt to 220 cSt; more typically from 40 cSt to 200 cSt, for example, a viscosity as measured without refrigerant at 40° C., of from 50 cSt to 140 cSt. As related above, at high $CO_2$ pressures the viscosity with be greatly reduced.

It is also important that the viscosity remains as consistent as possible across the typically encountered temperature range. The ester lubricant compositions of the invention not only exhibit excellent viscosities, measured without refrigerant at 40° C., of from 50 cSt to 140 cSt, but also demonstrate consistent viscosity over a wide range of temperatures as shown by their high viscosity indices, e.g., 120 or higher, typically 130 or higher.

Because of their particular combination of physical properties, the polyol ester lubricant compositions of the invention are ideally suited for working fluids containing $CO_2$. Other similar polyol esters possess a variety of useful properties, but do not exhibit the full compliment of performance criteria, that is, both lubricating properties and $CO_2$ miscibility, that are needed for a $CO_2$ based working fluid and found in the ester mixtures of the invention.

A series of polyol ester mixtures were prepared according to the two step process described above, details can be found in the Example section, and compared to similar compositions of the art.

In the following discussion, the polyol esters of Example 1 and 2 were prepared, from pentaerythritol and an approximately 100:1:1:1:1 molar ratio of n-pentanoic:n-hexanoic:n-heptanoic acid:n-octanoic:n-nonanoic acid. For Example 2, the ester composition of Example 1 was blended with di(2-ethylhexyl) neopentyl glycol to provide a 84:16 blend of the product of Example 1 and di(2-ethylhexyl) neopentyl glycol.

Examples 3, 4 and 5 were each prepared from pentaerythritol and an approximately 100:1:1:1 molar ratio of n-pentanoic:'iso-pentanoic':n-heptanoic acid:iso-nonanoic acid. The difference between examples 3, 4 and 5 is due to the amount of time the reactants were heated during the first step creating different amounts mono-, di-, tri- and higher oligomeric pentaerythritols.

As used herein, iso-pentanoic acid refers to the industrial chemical product which is available under that name and which is actually a mixture of about 34% 2-methylbutanoic acid and 66% n-pentanoic acid.

Example 6 was prepared from pentaerythritol and n-pentanoic acid.

Example 7 was from prepared from pentaerythritol and an approximately 100:100:1:1 molar ratio of n-pentanoic acid: iso-pentanoic acid:n-heptanoic acid:iso-nonanoic acid. As iso-pentanoic acid as used herein refers to a mixture which contains ~66% n-pentanoic acid, Example 7 still contains well over 50% n-pentanoyl groups as R.

Physical properties of Examples 1-6 are shown in Table 1.

TABLE 1

Physical Properties of Examples 1-6

| Examples | 1 | 2 | 3 | 4 | 5 | 6 | 7 |
|---|---|---|---|---|---|---|---|
| % Oligomer content (4 or more monomers) | 40 | 35 | 31 | 35 | 40 | 42 | 37 |
| Viscosity/40° C., cSt | 120 | 67.6 | 54.8 | 68.5 | 77.4 | 80.4 | 68.6 |
| Viscosity/100° C., cSt | 15.9 | 10.6 | 8.9 | 10.5 | 11.4 | 11.9 | 10.1 |
| Viscosity Index | 141 | 145 | 140 | 143 | 141 | 143 | 133 |
| Pour Point (° C.) | −40 | −60 | −43 | −48 | −45 | | −45 |
| Flash Point (° C.) | 266 | 210 | >250 | 254 | >250 | >250 | 260 |
| Density at 15.° C. (lbs/gal) | 8.72 | 8.54 | 8.73 | 8.73 | 8.70 | 8.70 | 8.68 |

As shown, excellent kinematic viscosity, viscosity index and pour points are obtained for all examples 1-7. The difference in viscosity in examples 3, 4 and 5 is due to the difference in the amount of time the reaction mixture was heated in stage 1 of the process.

Table 2 lists the physical properties of similar polyol ester lubricants based on pentaerythritol chemistry which contain a greater degree of branching in the alkylcarbonyl functionality, or linear alkylcarbonyl groups of at least 7 or more carbon atoms.

Comparative Examples A and C are commercial materials containing valeric acid, n-heptanoic acid, and 3,5,5-trimethylhexanoic acid esters of mono- and di-pentaerythritol.

Comparative Example B, also commercially available, comprises iso-pentanoic acid, n-heptanoic acid and 3,5,5-trimethylhexanoic acid esters of pentaerythritol.

Comparative Example D was prepared according to the procedure of Example 1 of U.S. patent application Ser. No. 12/684,315 and contains over 30% of the oligomers of 4 or more pentaerythritol monomers, however, the esters of comparative Example D are a mixture of n-heptanoic, n-octanoic acid and n-decanoic acid esters, predominately n-heptanoic.

TABLE 2

Physical Properties of Comparative Examples A-D

| Examples | A | B | C | D |
|---|---|---|---|---|
| Oligomer content (4 or more monomers) | 0 | 0 | 0 | >30 |
| Viscosity/40° C., cSt | 72.3 | 64.8 | 80.0 | 69.0 |
| Viscosity/100° C., cSt | 9.8 | 8.4 | 10.3 | 10.9 |
| Viscosity Index | 120 | 98 | 111 | 150 |
| Pour Point (° C.) | −39 | −40 | −39 | −46 |
| Flash Point (° C.) | 260 | 258 | 288 | 279 |
| Density at 15.5° C. (lbs/gal) | 8.20 | 8.07 | 8.36 | 8.21 |

As seen in Table 2, the commercial samples which lack the oligomeric portion of the instant invention and have high levels of branching in the carboxylate groups, i.e., Examples A, B and C, have lower viscosity index. Example D, which does contain the pentaerythritol oligomers has a viscosity index comparable to the polyol ester lubricant of the invention, however, as seen in Table 3 below, this oil is not sufficiently miscible with $CO_2$, possibly a result of the longer chain alkanoyl groups.

The lubricant compositions of the invention were evaluated using standard industry tests for general effectiveness as a lubricant for mechanical devices and also specifically for effectiveness as a part of a working fluid containing $CO_2$. It should be remembered that the relative amounts of polyol ester lubricant and $CO_2$ refrigerant found in a working fluid in a heat transfer device can vary widely depending on the stage of the refrigeration cycle, for example, the working fluid can comprise from 1 to 99%, e.g., 2 to 98%, by weight of the polyol ester lubricant or from 1 to 99%, e.g., 2 to 98%, by weight of the refrigerant based on the combined weight of lubricant and refrigerant. Therefore, any relative amounts reported in the examples or data tables herein of lubricant to refrigerant refer to the amounts of each component that are charged to the apparatus being used.

Table 3 lists performance characteristics of polyol ester lubricants above for the following: Load Carrying as direct load (lbs), ASTM D 3233 Falex Pin and Vee Block test, Method A; Miscibility of 10 wt % lubricant in carbon dioxide with carbon dioxide at −2° C.; and Lubricity as coefficient of friction in the absence of $CO_2$, fixed load of 30 Newtons @ 40° C.

TABLE 3

| Performance Data | | | | | | | | | | |
|---|---|---|---|---|---|---|---|---|---|---|
| Examples | 2 | 3 | 4 | 5 | 6 | 7 | A | B | C | D |
| Load Carrying Performance | 940-1075 | 1000 | 1000 | 1000 | 1000 | 925-950 | 875 | 850 | 870 | 1100 |
| $CO_2$ Miscibility below −2° C. | Yes | Yes | Yes | Yes | Yes | Yes | Yes | Yes | Yes | No |
| Lubricity (CofF) | 0.046 | 0.046 | 0.046 | 0.046 | 0.046 | 0.047 | 0.071 | 0.086 | 0.072 | 0.037 |

Lubricity results above were obtained using a MINI TRACTION MACHINE commercially available from PCS Instruments, which uses a rotating ball on rotating disk geometry. The coefficient of friction (CofF) was measured as the mean entrainment speed was ramped from 0 to 2 meters/second at a fixed slide-roll-ratio (SRR) of 50% with a fixed load of 30 Newtons at 40° C. The entrainment speed is defined as the mean speed of the ball and disk, (Vdisk+Vball)/2. The SRR is defined as [2(Vdisk−Vball)/(Vdisk+Vball)]*100. Measuring the coefficient of friction (CofF) as a function of entrainment speed at 40° C. shows how friction changes as the rate of oil entering the contact region increases. At low speeds the CofF is relatively high due to direct metal-to-metal asperity contact, but as the entrainment speed increases, pressure between the contacting surfaces increases due to increasing oil entrapment and there is a progression from metal-metal contact to partial asperity contact and eventually, complete fluid film lubrication.

As seen in Table 3, load carrying performance of Examples 2-6 are consistently higher than Examples A, B and C and comparable with Example D. Examples 2-6 also outperform Examples A, B and C in lubricity. Only Comparative Example D, which also contains relatively high amounts of pentaerythritol oligomers shows lubricating performance as good as inventive Examples 2-6. Significantly, however, comparative Example D was found to not be miscible with $CO_2$ at low temperatures.

Thus it is demonstrated that polyol ester lubricant compositions with high pentaerythritol oligomer content and straight chain carboxylates outperform similar lubricants with low or no oligomer content. Further, of the ester lubricants with high pentaerythritol oligomer content, only those with a majority of short chain alkylcarboxylate groups, e.g., n-pentanoyloxy, were miscible with $CO_2$ at low temperature. The composition of Example D, containing predominately n-heptanolyoxy groups, i.e., alkylcarboxylate groups which are only slightly longer than those of the invention, was not miscible with $CO_2$ at low temperature, and not as suitable as the ester compositions of the present invention for use as the predominate lubricant component in a $CO_2$ based working fluid.

Tests were also run to determine the impact of a $CO_2$ refrigerant on the properties of the lubricants in order to confirm the suitability of the inventive poly ester lubricants in a $CO_2$ containing working fluid. The presence of $CO_2$ in a lubricant is known to significantly lower its viscosity. The lubricant chosen for use with a $CO_2$ refrigerant must not only be miscible with $CO_2$, but the lubricant must maintain adequate viscosity to function. This combination of properties is key to a $CO_2$ working fluid and is difficult to attain.

The viscosity and composition of lubricant/$CO_2$ mixtures as a function of temperature and pressure were measured using a temperature controlled circulation loop apparatus comprising a pump, mass flow/density meter, high pressure viscometer, bulk lubricant/refrigerant reservoir and pressure transducer. Thermocouples are located at multiple locations in the loop as well as directly in the mass flow meter and viscometer. The design of the loop allows for continuous circulation of the liquid mixture as well as providing agitation to achieve rapid vapor-liquid equilibrium.

The lubricant was first charged to the system gravimetrically, the circulation loop was cooled to −10° C. and then the $CO_2$ was charged gravimetrically in an amount necessary to achieve the desired bulk $CO_2$/lubricant composition. For safety reasons the loop was not filled to capacity and a small vapor space existed at the top of the bulk reservoir, and a vapor space correction was applied to the composition to account for $CO_2$ in the vapor phase. After charging a gear pump circulated the liquid through the measurement devices. Bulk mixture pressure, liquid density and liquid viscosity were measured.

Incorporated into the viscometer housing are two high pressure sight glasses to allow observation of the liquid miscibility where, if bulk mixture pressure is within 1% of saturated refrigerant pressure, the mixture can be checked for possible phase separation.

The pressure of 35 Bar was chosen for study because it represents a typical low side pressure condition for applications with an evaporator temperature of 0° C. Measurements were collected in the temperature range from −10° C. to 120° C. and compositions of $CO_2$ in lubricant from 0 to 30 wt %. The compositions of the invention exhibit acceptable viscosity throughout, which values remain consistent over much of this range.

Data is reported below for 20° C. and 55° C. as these temperatures reflect the typical operating range for a compressor. Again, comparative Example D exhibits excellent viscosity under the conditions, but this composition has already been shown to have less than desired $CO_2$ miscibility at low temperatures. Comparative Examples A and Bare miscible with $CO_2$ but show significantly lower viscosity under these conditions. The composition of Example 2 which is also miscible with $CO_2$ exhibits a higher and much more acceptable viscosity.

TABLE 4

| Thermophysical Properties of Lubricant/CO2 Mixtures Measured at 35 Bar | | | | |
|---|---|---|---|---|
| Examples | 2 | A | B | D |
| Viscosity at 20° C. (cSt) | 8.9 | 5.4 | 3.9 | 12.5 |
| Viscosity at 55° C. (cSt) | 11.0 | 7.4 | 5.8 | 12.0 |

The polyol ester compositions of the invention thus demonstrate a superior combination of physical properties and performance characteristics and are ideally suited for use with $CO_2$ in heat transfer working fluids. This is believed to be true for traditional cycles where the refrigerant is sent through an evaporator and enters the gas state and then goes through a condenser to transform into a condensed state and in systems using transcritical $CO_2$ where the gas does not fully convert to a liquid.

Compositions of the invention have been found to be miscible with carbon dioxide at temperatures as low as −40° C., a significant improvement over the high load carrying polyol ester of comparative Example D, while maintaining higher lubricity performance than seen in other polyolester compositions such as Comparative Examples A, B and C.

The working fluids of the invention can comprise other components common to the art, including additives, other lubricants, and refrigerants in addition to carbon dioxide.

For example, other refrigerants which may be present in the working fluid include hydrocarbons, halocarbons, ammonia and the like, but in many embodiments of the invention $CO_2$ is the majority refrigerant, and often, $CO_2$ is the sole refrigerant. The mixing ratio of the polyol ester lubricant to the refrigerant is not particularly restricted, but the lubricant may be present in a ratio of 1 to 500 parts by weight, more preferably 2 to 400 parts by weight per 100 parts by weight of the refrigerant.

Halocarbon refrigerants include fluorocarbon and hydrofluorocarbon compounds such as carbon tetrafluoride (R-14), difluoromethane (R-32), 1,1,1,2-tetrafluoroethane (R-134a), 1,1,2,2-tetrafluoroethane (R-134), pentafluoroethane (R-125), 1,1,1-trifluoroethane (R-143a) and tetrafluoropropene (R-1234yf) and mixtures comprising fluorocarbons, hydrofluorocarbons and/or hydrocarbons are well known and may be used in the present working fluids.

Common additives which may also be present in the working fluid include antioxidants, extreme-pressure additives, antiwear additives, friction reducing additives, defoaming agents, profoaming agents, metal deactivators, acid scavengers and the like.

Examples of the antioxidants that can be used include phenolic antioxidants such as 2,6-di-t-butyl-4-methylphenol and 4,4'-methylenebis(2,6-di-t-butylphenol); amine antioxidants such as p,p-dioctylphenylamine, monooctyldiphenylamine, phenothiazine, 3,7-dioctylphenothiazine, phenyl-1-naphthylamine, phenyl-2-naphthylamine, alkylphenyl-1-naphthylamine, and alkylphenyl-2-naphthylamine; sulfur-containing antioxidants such as alkyl disulfide, thiodipropionic acid esters and benzothiazole; and zinc dialkyl dithiophosphate and zinc diaryl dithiophosphate.

Examples of the extreme-pressure additives, antiwear additives, friction reducing additives that can be used include zinc compounds, such as zinc dialkyl dithiophosphate and zinc diaryl dithiophosphate; sulfur compounds such as thiodipropinoic acid esters, dialkyl sulfide, dibenzyl sulfide, dialkyl polysulfide, alkylmercaptan, dibenzothiophene and 2,2'-dithiobis(benzothiazole); sulfur/nitrogen ashless antiwear additives such as dialkyldimercaptothiadiazoles and methylenebis(N,N-dialkyldithiocarbamates); phosphorus compounds such as triaryl phosphates such as tricresyl phosphate and trialkyl phosphates; dialkyl or diaryl phosphates; trialkyl or triaryl phosphites; amine salts of alkyl and dialkylphosphoric acid esters such as the dodecylamine salt of dimethylphosphoric acid ester; dialkyl or diaryl phosphites; monoalkyl or monoaryl phosphites; fluorine compounds such as perfluoroalkyl polyethers, trifluorochloroethylene polymers and graphite fluoride; silicon compounds such as a fatty acid-modified silicone; molybdenum disulfide, graphite, and the like. Examples of organic friction modifiers include long chain fatty amines and glycerol esters.

Examples of the defoaming and profoaming agents that can be used include silicone oils such as dimethylpolysiloxane and organosilicates such as diethyl silicate. Examples of the metal deactivators that can be used include benzotriazole, tolyltriazole, alizarin, quinizarin and mercaptobenzothiazole. Furthermore, epoxy compounds such as phenyl glycidyl ethers, alkyl glycidyl ethers, alkylglycidyl esters, epoxystearic acid esters and epoxidized vegetable oil, organotin compounds and boron compounds may be added as acid scavengers or stabilizers.

Examples of moisture scavengers include trialkylorthoformates such as trimethylorthoformate and triethylorthoformate, ketals such as 1,3-dioxacyclopentane, and amino ketals such as 2,2-dialkyloxazolidines.

The working fluids comprising the present polyol esters and a refrigerant can be used in a wide variety of refrigeration and heat energy transfer applications. Non-limiting examples include all ranges of air conditioning equipment from small window air conditioners, centralized home air conditioning units to light industrial air conditioners and large industrial units for factories, office buildings, apartment buildings and warehouses. Refrigeration applications include small home appliances such as home refrigerators, freezers, water coolers, vending machines and icemakers to large scale refrigerated warehouses and ice skating rinks. Also included in industrial applications would be cascade grocery store refrigeration and freezer systems. Heat energy transfer applications include heat pumps for house hold heating and hot water heaters. Transportation related applications include automotive and truck air conditioning, refrigerated semi-trailers as well as refrigerated marine and rail shipping containers.

Types of compressors useful for the above applications can be classified into two broad categories; positive displacement and dynamic compressors. Positive displacement compressors increase refrigerant vapor pressure by reducing the volume of the compression chamber through work applied to the compressor's mechanism. Positive displacement compressors include many styles of compressors currently in use, such as reciprocating, rotary (rolling piston, rotary vane, single screw, twin screw), and orbital (scroll or trochoidal). Dynamic compressors increase refrigerant vapor pressure by continuous transfer of kinetic energy from the rotating member to the vapor, followed by conversion of this energy into a pressure rise. Centrifugal compressors function based on these principles.

EXAMPLES

In the following working examples a mixture of esters of mono-, di-, tri-, and poly-pentaerythritol compounds are prepared, the relative amounts of which as determined by gel permeation chromatography are shown in Table 5. As used herein, iso-pentanoic acid refers to the industrial chemical product which is available under that name and which is actually a mixture of about 34% 2-methylbutanoic acid and 66% n-pentanoic acid.

Example 1

Step 1: To a reactor equipped with a mechanical stirrer, Dean-Stark trap, condenser, nitrogen sparger, and vacuum source was charged 3418.5 grams (25.11 moles) of pentaerythritol, n-pentanoic acid (4880.9 grams, 47.79 moles), n-hexanoic acid (50.1 grams, 0.43 moles), n-heptanoic acid (50.1 grams, 0.39 moles), n-octanoic acid (50.1 grams, 0.35 moles), n-nonanoic acid (50.1 grams 0.32 moles), and a catalytic amount of methanesulfonic acid. The reaction mixture was heated to a temperature of about 170° C., vacuum was applied and water of reaction was removed and collected in the Dean-Stark trap while acid was returned to the reaction. The reaction was continued until the amount of equivalent to the water produced in the ester and ether forming reactions was collected.

Step 2: The reaction mixture containing a partially esterified mixture of pentaerythritol, dipentaerythritol, tripentaerythritol and higher pentaerythritol oligomers was cooled to about 134° C., the methanesulfonic acid was neutralized with sodium carbonate, additional n-pentanoic acid, n-hexanoic acid, n-heptanoic acid, n-octanoic acid and n-nonanoic acid in the molar ratios above in an amount sufficient to react with any free hydroxyl groups. A catalytic amount of tin oxalate and activated carbon was added and the mixture was heated at 240° C. for about 8 hours. During this time, the water of reaction was collected until the hydroxyl value of the reaction mixture was less than 3.0 mg KOH/g. In order to remove excess acid vacuum was applied and the reaction mixture was held at 240° C. for about 3 additional hours. When the acid value of the reaction mixture was less than 1.0 mg KOH/g, the reaction mixture was cooled to 80° C., any residual acidity was neutralized with sodium carbonate and the product was filtered to remove any insoluble alkali. The final polyester product had a viscosity of 125 cSt at 40° C., a hydroxyl value of about 2.0 mg KOH/g, and an acid value of 0.01 mg KOH/g.

Example 2

The product of Example 1 was blended with di(2-ethylhexyl)neopentylglycol to afford a product possessing a kinematic viscosity of 67.6 cSt at 40° C. The final composition contained about 16 wt % of di(2-ethylhexyl)neopentylglycol and about 84 wt % of the product in Example 1. Other physical properties of the product are provided in Table 1.

Example 3

Following the procedure of Example 1, a product with a viscosity of 54.8 cSt at 40° C. was obtained by reacting in Step 1: pentaerythritol (569.2 grams, 4.18 moles), n-pentanoic acid (999.8 grams, 9.79 moles), iso-pentanoic acid (10.3 grams, 0.10 moles), n-heptanoic acid (10.3 moles, 0.08 moles), iso-nonanoic acid (10.3 grams, 0.07 moles), and a catalytic amount of methanesulfonic acid, followed by final conversion to the fully esterified product using the same molar ratio of additional carboxylic acid in Step 2 as used in step 1.

Example 4

The procedure of Example 3 was repeated with twice the initial charge of polyol and carboxylic acid, i.e., pentaerythritol (1236.2 grams, 9.08 moles), n-pentanoic acid (2098.2 grams, 20.54 moles), iso-pentanoic acid (21.8 grams, 0.21 moles), n-heptanoic acid (21.8 moles, 0.17 moles), iso-nonanoic acid (21.8 grams, 0.14 moles), except that the reaction mixture in Step 1 was heated to a temperature of about 170° C. under applied vacuum for a longer period of time and a greater amount of water of reaction relative to the amount of reactants was removed.

Due to the longer heater time a greater amount of oligomer was produced in step 1 and the product obtained had a viscosity of 68.5 cSt at 40° C.

Example 5

Example 4 was repeated except that the reaction mixture in Step 1 was heated to a temperature of about 170° C. under applied vacuum for an even longer period of time to remove a greater amount of water of reaction relative to amount of reactants and generate a larger amount of oligomer, yielding a product with a viscosity of 77.4 cSt at 40° C.

Example 6

Following the procedure of Example 1, a product with a viscosity of 80.2 cSt at 40° C. was obtained by reacting in Step 1: pentaerythritol (640.0 grams, 4.70 moles), n-pentanoic acid (960.0 grams, 9.40 moles), and methane sulfonic acid catalyst, followed by final conversion to the fully esterified product using additional n-pentanoic acid in Step 2.

Example 7

Following the procedure of Example 1, a product with a viscosity of 68.6 cSt at 40° C. was obtained by reacting in Step 1: pentaerythritol (1245.2 grams, 9.15 moles), n-pentanoic acid (1127.4 grams, 11.01 moles), iso-pentanoic acid (1082.2 grams, 10.60 moles), heptanoic acid (22.6 grams, 0.08 moles), iso-nonanoic acid (22.6 grams, 0.07 moles), and a catalytic amount of methanesulfonic acid, followed by final conversion to the fully esterified product using the same molar ratio of additional carboxylic acid in Step 2 as used in step 1.

Comparative Example A

Comparative Example A is a traditional premium ISO 68 polyol ester refrigeration lubricant commercially available from CPI Engineering Services under the trade name EMKARATE RL 68H, which is the reaction product of an approximately 1:1 wt % ratio of technical grade pentaerythritol and dipentaerythritol with an excess of valeric acid, n-heptanoic acid, and 3,5,5-trimethylhexanoic acid in roughly an 18:27:55 wt % ratio.

Comparative Example B

Comparative Example B is a traditional ISO 68 polyol ester refrigeration lubricant commercially available from ExxonMobil Corporation as EAL ARCTIC 68 which is the pentaerythritol ester of iso-pentanoic acid (a roughly 34 wt % mixture of 2-methlybutanoic acid and 66 wt % valeric acid), n-heptanoic acid and 3,5,5-trimethylhexanoic acid.

Comparative Example C

Comparative Example C is a traditional ISO 85 polyol ester refrigeration lubricant commercially available from Fuchs Europe Schmierstoffe, GMBH as RENISO C85 E which is a mixture of monopentaerythritol and dipentaerythritol esters derived from valeric acid, n-heptanoic acid, and 3,5,5-trimethylhexanoic acid.

Comparative Example D

Comparative Example D was prepared using the procedure of Example 1 of U.S. patent application Ser. No. 12/684,315. The initial reactor charge for consisted of pentaerythritol (392 grams, 2.88 moles), n-heptanoic acid (720 grams, 5.54 moles), and methane sulfonic acid catalyst. Following the initial esterification and condensation step, n-heptanoic acid (236.6 grams, 1.82 moles) and a blend of n-octanoic and n-decanoic acids (264.4 grams, 2.05 moles) were added to complete the second esterification step described in the procedure above. The reaction product was blended with approximately 275 grams of a technical pentaerythritol ester of n-heptanoic, n-octanoic acid and n-decanoic acid to afford a final composition with a target viscosity grade of ISO 68, measure at 69.0 at 40° C.

TABLE 5

Proportion of mono-, di-, tri-, and poly- pentaerythritol esters

| Examples | 1 | 2 | 3 | 4 | 5 | 6 | 7 | A | B | C | D |
|---|---|---|---|---|---|---|---|---|---|---|---|
| Mono-PE | 24 | 34 | 39 | 34 | 33 | 28 | 37 | 45 | 100 | 34 | 47 |
| Di-PE 16 | 19 | 19 | 19 | 17 | 18 | 17 | 55 | 0 | 59 | 17 | |
| Tri-PE | 10 | 12 | 12 | 12 | 11 | 12 | 11 | 0 | 0 | 7 | 7 |
| Poly-PE | 50 | 35 | 31 | 35 | 40 | 42 | 35 | 0 | 0 | 0 | 32 |

Mono-PE = relative amount of mono-pentaerythritol esters

Di-PE = relative amount of di-pentaerythritol esters

Tri-PE = relative amount of Tri-pentaerythritol esters poly-PE = relative amount of esters of pentaerythritol oligomers of 4 or higher pentaerythritol units

What is claimed:

1. A working fluid for a heat transfer device comprising i) $CO_2$ as a refrigerant, and ii) a polyol ester lubricant composition having a viscosity index of 130 or higher comprising a mixture of esters of formula I

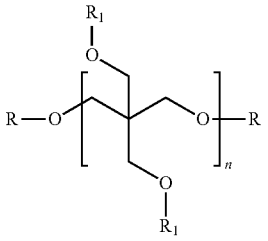

wherein n is an integer of from 1 to 20, each R is independently an alkyl carbonyl of from 5 to 10 carbon atoms, each $R_1$ is independently selected and is either a group R or a substituent of formula II:

II

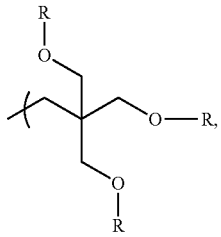

and wherein from 70% to 100% of all R groups in the mixture of compounds of formula I are selected from isomers of alkyl carbonyl groups of 5 carbon atoms, at least 50% of all groups R in the compounds of formula I present in the working fluid are n-pentanoyl, and wherein the polyol ester lubricant composition ii) comprises:

a) from 20 to 45 wt % compounds of formula I wherein n is 1 and each $R_1$ is independently selected and is a group R, b) from 15 to 20 wt % compounds of formula I wherein n is 2 and each $R_1$ is independently selected and is a group R, c) from 10 to 15 wt % compounds of formula I wherein n is 3 and each $R_1$ is independently selected and is a group R, and d) from 30 to 55 wt % compounds of formula I which are pentaerythritol oligomers of 4 or more pentaerythritol monomer groups.

2. The working fluid according to claim 1 wherein at least 70% of all R groups in the mixture of compounds of formula I are n-pentanoyl.

3. The working fluid according to claim 1 further comprising in addition to components i) and ii), a hydrocarbon refrigerant, halocarbon refrigerant, ammonia, mineral oil, poly-α-olefin, alkylbenzenes, carboxylic acid ester other than a compound of formula I, polyether, polyvinyl ether, perfluoropolyether, phosphoric acid ester or mixture thereof.

4. The working fluid according to claim 1 comprising a halocarbon refrigerant selected from the group consisting of carbon tetrafluoride (R-14), difluoromethane (R-32), 1,1,1,2-tetrafluoroethane (R-134A), 1,1,2,2-tetrafluoroethane (R-134), pentafluoroethane (R-125), 1,1,1-trifluoroethane (R-143A) and tetrafluoropropene (R-1234YF).

5. The working fluid according to claim 1 further comprising one or more antioxidant, extreme-pressure additive, anti-wear additive, friction reducing additive, defoaming agent, profoaming agent, metal deactivator, acid scavenger or mixture thereof.

* * * * *